US009243802B2

(12) United States Patent
Hawie et al.

(10) Patent No.: US 9,243,802 B2
(45) Date of Patent: Jan. 26, 2016

(54) TWO-STAGE COMBUSTOR FOR GAS TURBINE ENGINE

(75) Inventors: Eduardo Hawie, Woodbridge (CA); Nigel Davenport, Hillsburgh (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 1084 days.

(21) Appl. No.: 13/313,321

(22) Filed: Dec. 7, 2011

(65) Prior Publication Data

US 2013/0145741 A1 Jun. 13, 2013

(51) Int. Cl.

| | |
|---|---|
| ***F23R 3/06*** | (2006.01) |
| ***F23R 3/16*** | (2006.01) |
| ***F23R 3/44*** | (2006.01) |
| ***F23R 3/26*** | (2006.01) |
| ***F23R 3/34*** | (2006.01) |

(52) U.S. Cl.

CPC ... *F23R 3/06* (2013.01); *F23R 3/16* (2013.01); *F23R 3/26* (2013.01); *F23R 3/346* (2013.01); *F23R 3/44* (2013.01)

(58) Field of Classification Search

CPC ..... F23R 3/26; F23R 3/06; F23R 3/44; F23R 3/346; F23R 3/16

USPC ..... 60/740, 794, 804, 39.23, 746, 39.37

See application file for complete search history.

(56) References Cited

U.S. PATENT DOCUMENTS

| | | | | |
|---|---|---|---|---|
| 3,872,664 | A | 3/1975 | Lohmann et al. | |
| 3,937,008 | A | 2/1976 | Markowski et al. | |
| 3,958,413 | A * | 5/1976 | Cornelius | F23R 3/14 60/39.23 |
| 4,045,956 | A | 9/1977 | Markowski et al. | |
| 4,058,977 | A | 11/1977 | Markowski et al. | |
| 4,246,758 | A | 1/1981 | Caruel et al. | |
| 4,470,262 | A | 9/1984 | Shekleton | |
| 5,163,284 | A * | 11/1992 | Shekleton | 60/804 |
| 5,177,956 | A * | 1/1993 | Shekleton | 60/804 |
| 5,285,635 | A | 2/1994 | Savelli et al. | |
| 5,289,687 | A | 3/1994 | Kress et al. | |
| 5,295,354 | A | 3/1994 | Barbier et al. | |
| 5,311,743 | A | 5/1994 | Ansart et al. | |
| 5,490,380 | A | 2/1996 | Marshall | |
| 5,653,109 | A | 8/1997 | Overton et al. | |
| 5,816,050 | A | 10/1998 | Sjunnesson et al. | |
| 5,862,668 | A | 1/1999 | Richardson | |
| 5,894,720 | A * | 4/1999 | Willis et al. | 60/776 |
| 6,016,658 | A * | 1/2000 | Willis et al. | 60/737 |
| 6,058,710 | A | 5/2000 | Brehm | |
| 6,324,828 | B1 * | 12/2001 | Willis et al. | 60/773 |
| 6,405,523 | B1 | 6/2002 | Foust et al. | |
| 6,453,658 | B1 * | 9/2002 | Willis et al. | 60/804 |
| 6,481,209 | B1 | 11/2002 | Johnson et al. | |
| 6,684,642 | B2 * | 2/2004 | Willis et al. | 60/746 |
| 6,732,531 | B2 * | 5/2004 | Dickey | 60/794 |
| 6,968,699 | B2 | 11/2005 | Howell et al. | |

(Continued)

*Primary Examiner* — Phutthiwat Wongwian
*Assistant Examiner* — Carlos A Rivera
(74) *Attorney, Agent, or Firm* — Norton Rose Fulbright Canada LLP

(57) ABSTRACT

A combustor for a gas turbine engine comprises an inner annular liner and an outer annular liner. A first and a second combustion stages are defined between the liners, each said combustion stage having a plurality of fuel injection bores distributed in a liner wall defining the respective stage. Valves at the fuel injection bores of one of the combustion stages, the valves each defining an air passage from an exterior to an interior of the combustion stage, the valves each having an actuatable member for adjusting a size of a respective air passage for air staging the combustor.

18 Claims, 5 Drawing Sheets

(56) References Cited

U.S. PATENT DOCUMENTS

| | | | | |
|---|---|---|---|---|
| 7,055,331 | B2 | 6/2006 | Graf et al. | |
| 7,506,511 | B2 | 3/2009 | Zupanc et al. | |
| 7,716,931 | B2 | 5/2010 | Mancini et al. | |
| 7,966,821 | B2 | 6/2011 | Zupanc et al. | |
| 2011/0185735 | A1 | 8/2011 | Snyder | |
| 2013/0145766 | A1* | 6/2013 | Hawie et al. | 60/740 |
| 2013/0145767 | A1* | 6/2013 | Hawie et al. | 60/740 |

* cited by examiner

TWO-STAGE COMBUSTOR FOR GAS TURBINE ENGINE

TECHNICAL FIELD

The application relates generally to gas turbine engines and, more particularly, to two-stage combustors.

BACKGROUND OF THE ART

In two-stage combustors, the combustor is comprised of two sub-chambers, one for the pilot stage of the burner, and the other for the main stage of the burner. The pilot stage operates the engine at low power settings, and is kept running at all conditions. The pilot stage is also used for operability of the engine to prevent flame extinction. The main stage is additionally operated at medium- and high-power settings. The arrangement of two-stage combustors involves typically complex paths, and may make avoiding dynamic ranges with their increased-complexity geometry more difficult. Also, problems may occur in trying to achieve a proper temperature profile. Finally, durability has been problematic.

SUMMARY

In one aspect, there is provided a combustor for a gas turbine engine comprising: an inner annular liner; an outer annular liner; a first and second combustion stages defined between the liners, each said combustion stage having a plurality of fuel injection bores distributed in a liner wall defining the respective stage; and valves at the fuel injection bores of one of the combustion stages, the valves each defining an air passage from an exterior to an interior of the combustion stage, the valves each having an actuatable member for adjusting a size of a respective air passage for air staging the combustor.

In a second aspect, there is provided a gas turbine engine comprising: a combustor chamber outer case casing defining a plenum; a combustor within the plenum and comprising: an inner annular liner; an outer annular liner; a first and second combustion stages defined between the liners, each said combustion stage having a plurality of fuel injection bores distributed in a liner wall defining the respective stage; injectors at the injection bores of the first combustion stage; and valves at the fuel injection bores of the second combustion stage, the valves each defining an air passage from an exterior to an interior of the combustion stage, the valves each having an actuatable member for adjusting a size of a respective air passage for air staging the combustor; and a diffuser having outlets communicating with the plenum.

Further details of these and other aspects of the present invention will be apparent from the detailed description and figures included below.

DESCRIPTION OF THE DRAWINGS

Reference is now made to the accompanying figures, in which:

FIG. 6 is a sectioned perspective view of a rotational staging valve of the two-stage combustor of FIG. 2, in a closed position.

DETAILED DESCRIPTION OF THE PREFERRED EMBODIMENTS

Figure 1:
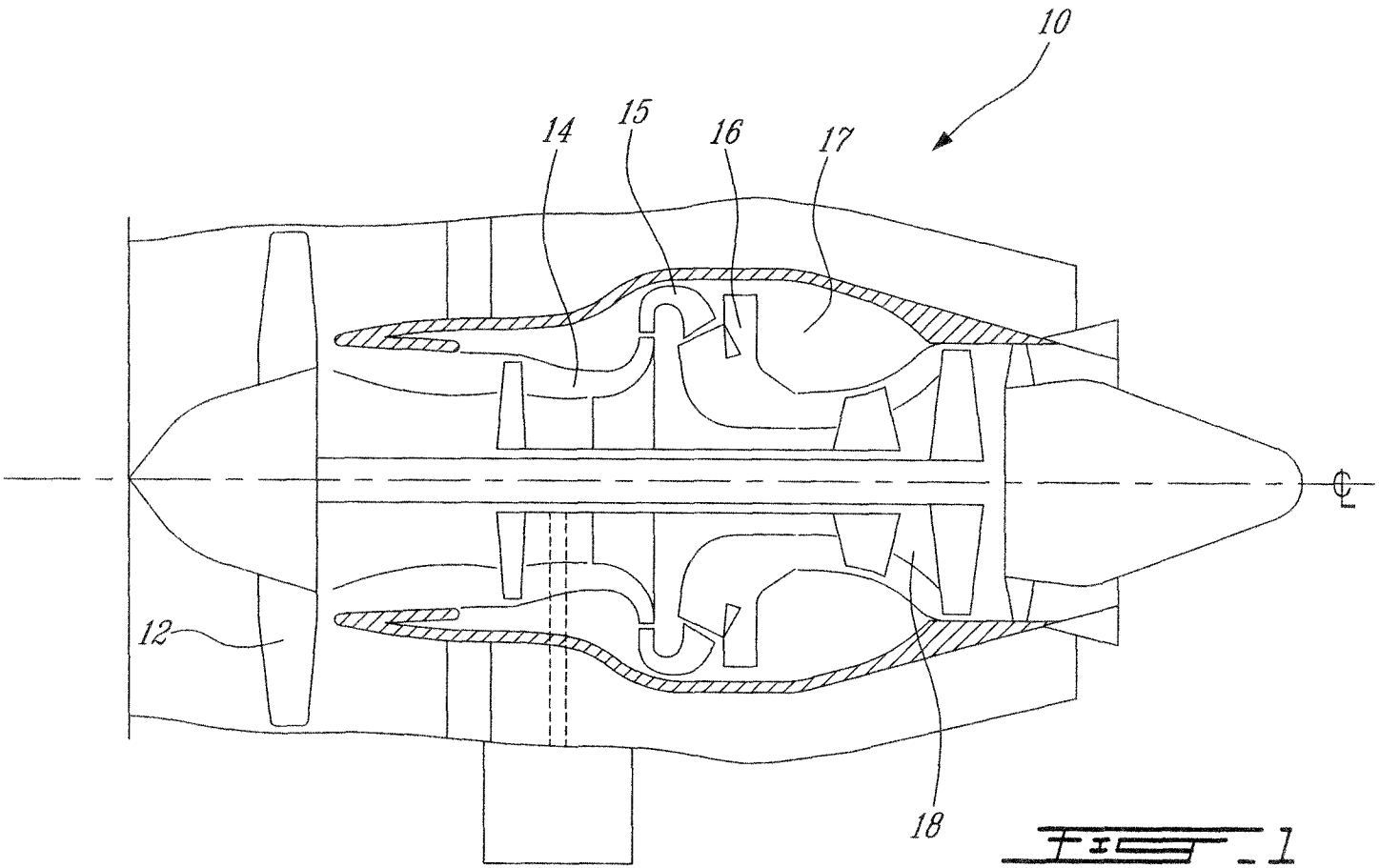
FIG. 1 is a schematic cross-sectional view of a turbofan gas turbine engine with a two-stage combustor in accordance with the present disclosure.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air, a plurality of curved radial diffuser pipes 15 in this example, a combustor 16 in which the compressed air is mixed with fuel and ignited for generating an annular stream of hot combustion gases, a plenum 17 defined by the casing and receiving the radial diffuser pipes 15 and the combustor 16, and a turbine section 18 for extracting energy from the combustion gases. The combustor 16 is a two-stage combustor in accordance with the present disclosure.

Figure 2:
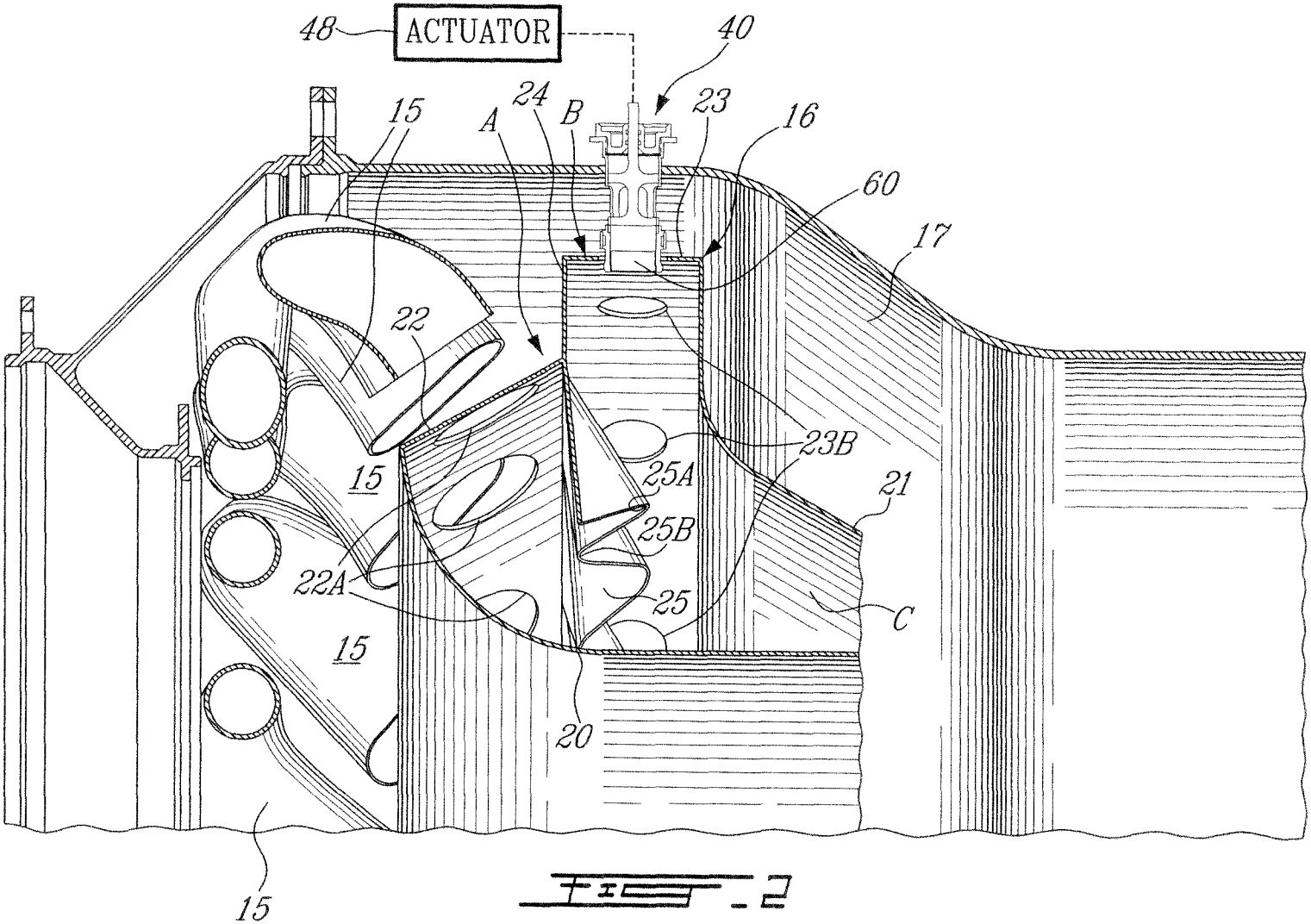
FIG. 2 is an enlarged sectional view, fragmented, of the two-stage combustor of the present disclosure, showing a staging valve.

Referring to FIG. 2, the combustor 16 of the present disclosure is shown in greater detail. The combustor 16 has an annular geometry, with an inner liner wall 20, and an outer liner wall 21 concurrently defining the combustion chamber therebetween. The inner liner wall 20 has a fore end oriented generally radially relative to the engine centerline, with the inner liner wall 20 curving into an axial orientation relative to the engine centerline. Likewise, the outer liner wall 21 has a fore end oriented generally radially relative to the engine centerline, with the outer liner wall 21 curving into an oblique orientation relative to the engine centerline.

A dome interrelates the inner liner wall 20 to the outer liner wall 21. The dome is the interface between air/fuel injection components and a combustion chamber. The dome has a first end wall 22 (i.e., dome wall) sharing an edge with the inner liner wall 20. The first end wall 22 may be in a non-parallel orientation relative to the engine centerline. Injection bores 22A are circumferentially distributed in the first end wall 22.

A second end wall 23 (i.e., dome wall) of the dome shares an edge with the outer liner wall 21. The second end wall 23 may be in a generally parallel orientation relative to the engine centerline, or in any other suitable orientation. Injection bores 23B are circumferentially distributed in the first end wall 23. In the illustrated embodiment, the first end wall 22 may be wider than the second end wall 23.

An intermediate wall 24 of the dome may join the first end wall 22 and the second end wall 23, with the second end wall 23 being positioned radially farther than the first end wall 22 (by having a larger radius of curvature than that of the first end wall 22 relative to the engine centerline), the second end wall 23 therefore being closer to the combustor chamber outer case. The intermediate wall 24 may be normally oriented relative to the engine centerline. In this example, mixing features extend into the combustion chamber from the dome walls. The mixing features may be a mixer wall 25 extending from the intermediate wall 24 and projects into an inner cavity of the combustor 16. The mixer wall 25 may have a lobed annular pattern, as illustrated in FIG. 2, with a succession of peaks and valleys along a circumference of the mixer wall 25. The lobed mixer wall 25 in between the stages can be made out of composite materials (e.g. CMC) or metal. Although not shown, the lobed mixer wall 25 may be cooled by conventional methods (i.e., louvers, effusion and/or back side cooling).

Figure 3:
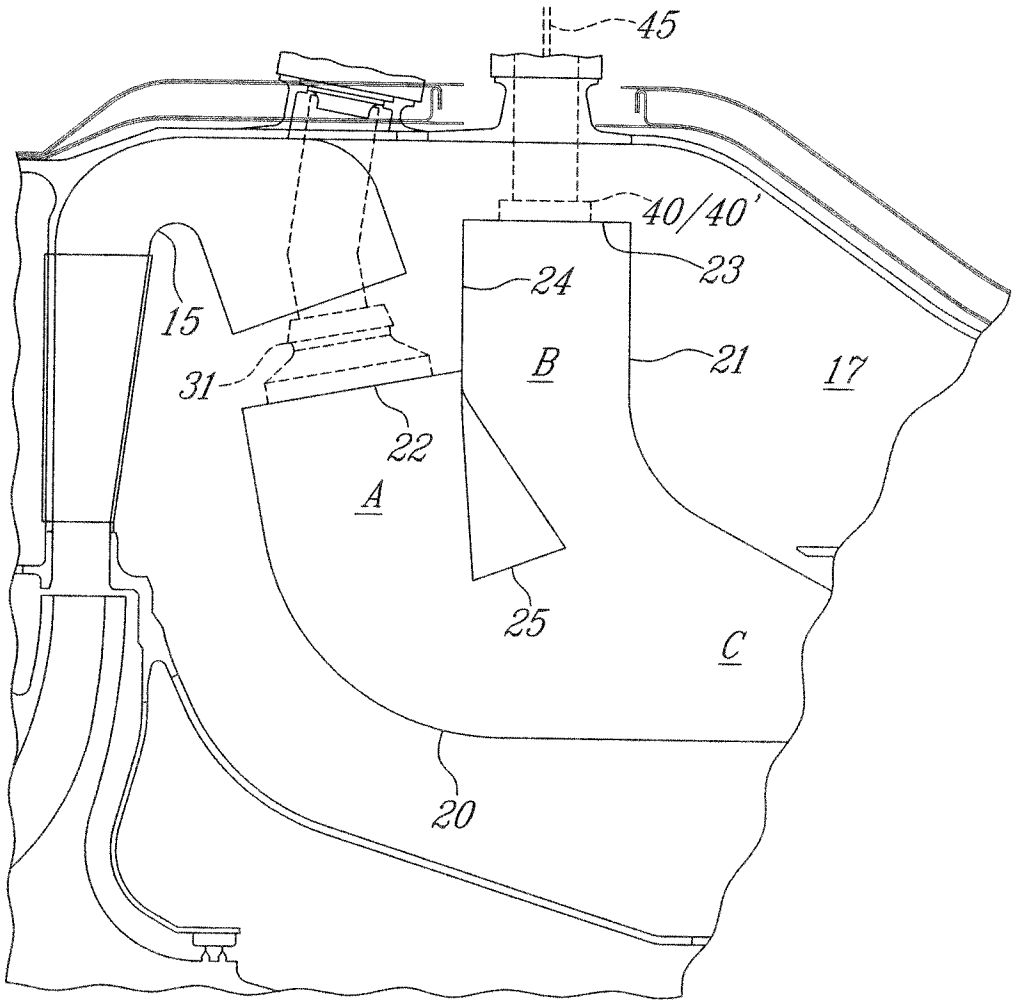
FIG. 3 is a schematic view of the two-stage combustor of FIG. 2, with diffusers, injectors and staging valves.

As shown in FIGS. 2 and 3, the injection bores may be radially offset from one another by reason of the larger radius of the second end wall 23. Therefore, there is a clearance opposite the injection bores 22A, thus defining a volume for the installation and presence of injectors or staging valves.

Accordingly, as shown in FIGS. 2 and 3, the combustor 16 comprises a pair of annular portions, namely A and B, merging into an aft portion C of the combustor 16. The annular portion A is defined by the inner liner wall 20, the first end wall 22 and a fore surface of the mixer wall 25. The annular portion B is defined by the outer liner wall 21, the second end wall 23, the intermediate wall 24, and an aft surface of the mixer wall 25. Dilution ports may be defined in the liners of the aft portion C, to trim the radial profile of the combustion products.

Either one of the annular portions A and B may be used for the pilot stage, while the other of the annular portions A and B may be used for the main combustion stage. Referring to FIG. 3, as an example, the annular portion A is used for the pilot stage. In this example, the main combustion stage is therefore represented by the annular portion B. Moreover, in this example, the pilot combustion stage is entirely axially forward of the main combustion stage.

Accordingly, injectors 31 are schematically illustrated as being mounted to the combustor outer case and as floating on the annular portion A, in register with respective floating collars at injection bores 22A, for the feed of plenum air and fuel to the annular portion A of the combustor 16. The annular portion B is used as the main stage in the case, and therefore features staging valves 40, as shown in FIG. 2. The staging valves 40 for annular portion B may have the same attachment arrangement as the injectors 31 for the annular portion A.

Figure 5:
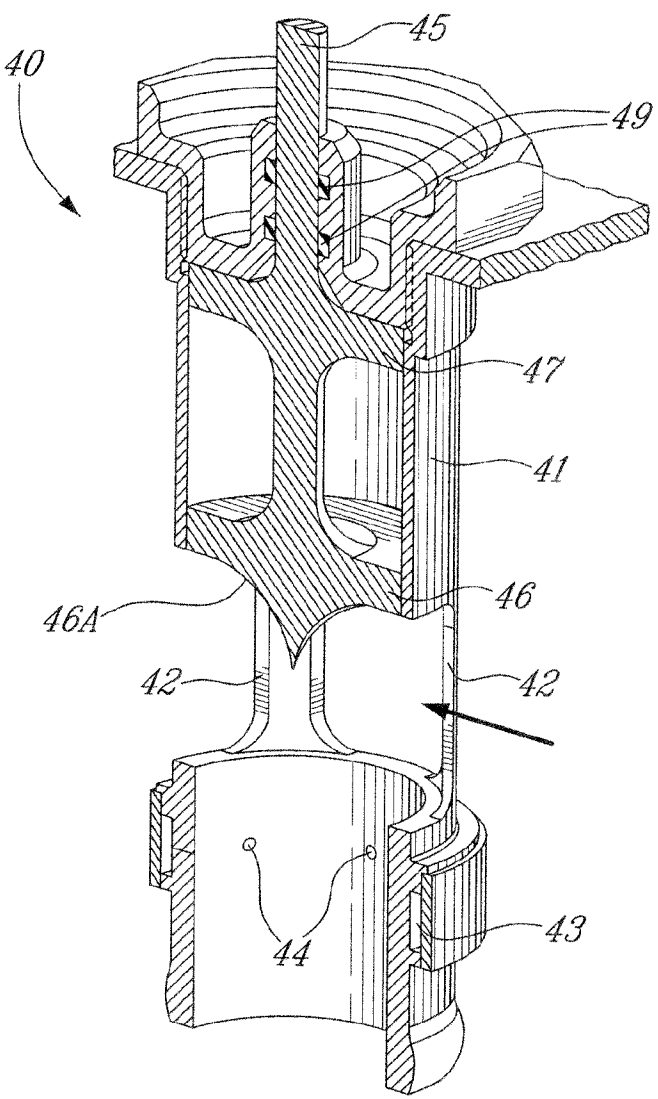
FIG. 5 is a sectioned perspective view of the plunger-type staging valve of FIG. 4, in an open position.
Figure 4:
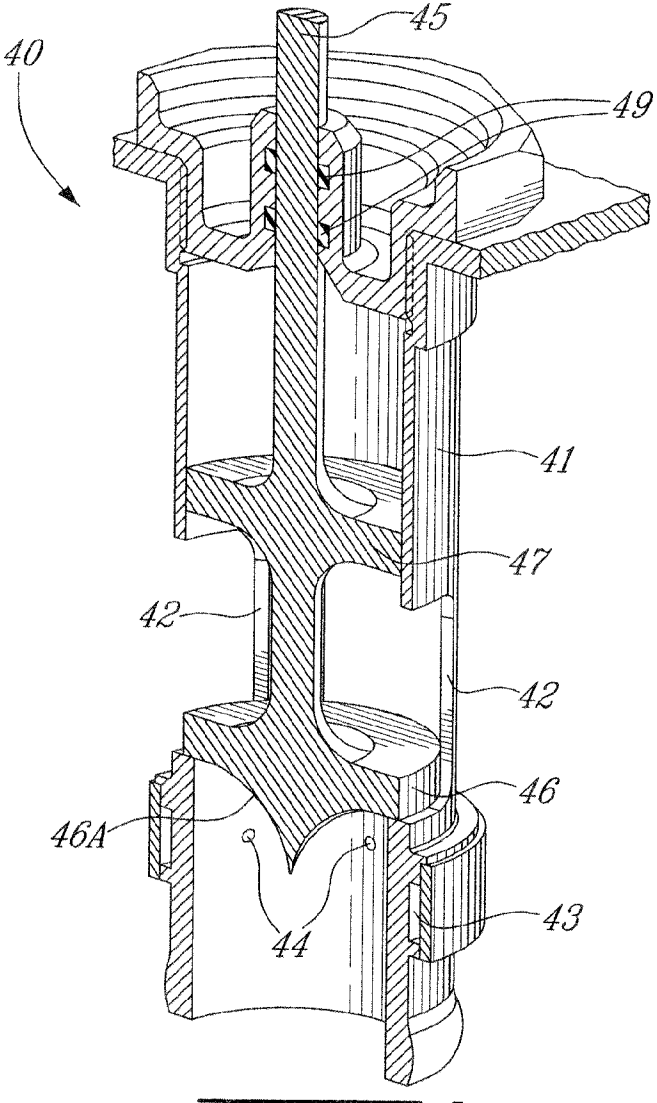
FIG. 4 is a sectioned perspective view of a plunger-type staging valve of the two-stage combustor of FIG. 2, in a closed position.

An embodiment of the staging valve 40 is shown in greater detail in FIGS. 4 and 5. The staging valve 40 has a cylinder 41 that extends from the combustor chamber outer case to the annular portion B. The cylinder 41 may be fixedly secured to the combustor chamber outer case, for instance by way of threading engagement. The staging valves 40 may act as a combustor mounting device. Injectors 31 may then float with respect to the liner, for instance by the use of floating collars at the injection bores 22A. Any appropriate connection configuration may be used between the cylinder 41, the combustor chamber outer case and the combustor outer case. The radially inward end of the cylinder 41 is therefore open to the interior of the combustor, thereby defining a fluid passage. Lateral openings 42 are defined in the wall of the cylinder 41, and are located within the plenum 17 (FIGS. 2 and 3). Thus, fluid may flow from the plenum 17, to the interior of the combustor, via the cylinder 41. There may be one or more of the lateral openings 42, in any appropriate size.

A channel 43 is defined about the cylinder 41, for instance by using a sleeve, by forming an annular groove in the cylinder 41, etc. The channel 43 receives a fuel supply from any appropriate fuel supply conduit, etc. The channel 43 is in fluid communication with an interior of the cylinder 41 by way of ports 44, distributed circumferentially in the cylinder 41. The number and size of the ports 44 is a function of the amount of fuel that must be fed from the channel 43 to an interior of the cylinder 41. The fuel/air mixing will take place by the use of swirlers, for instance placed upstream of the fuel injection ports.

The staging valve 40 of FIGS. 4 and 5 may be a plunger-type valve, featuring a shaft 45 that is axially displaceable within the cylinder 41. The shaft 45 supports a pair of pistons 46 and 47 at an end, and projects outside the cylinder 41 at the opposed end. The shaft 45 is sized such that its projecting end is located outside of the combustor chamber outer case, in such a way that a valve actuator 48 may be also located on or outside the combustor chamber outer case. Appropriate seals or packing 49 are provided between the shaft 45 and a collar of the combustor chamber outer case, to generally prevent leaks therebetween. FIGS. 4 and 5 show a pair of the seals 49, although more or less sealing means may be used.

The piston 46 is located radially inwardly on the shaft 45 relative to the piston 47. The pistons 46 and 47 may be integral with the shaft 45. The pistons 46 and 47 are spaced apart by a distance generally equivalent to a height of the lateral openings 42, whereby a by-pass fluid passage is defined concurrently by the pistons 46 and 47, and the openings 42, as in FIG. 4. In FIG. 4, the staging valve 40 is in a closed position, in that the piston 46 closes the passage of fluid from the plenum 17 (FIG. 2) to the interior of the combustor.

Referring to FIGS. 4 and 5, the radially inward surface 46A of the piston 46 defines a cone-like geometry, among numerous other possible geometry. The cone-like geometry may have a radius at its junction with a remainder of the piston 46. In FIG. 5, the staging valve 40 is in an open position, with the piston 46 being displaced to allow fluid to enter the combustor from the plenum 17, via the lateral openings 42. The cone-like geometry of the surface 46A of the piston 46 may serve as a deflector to guide the fluid flow into the cylinder 41. The position of the piston 46 relative to the lateral openings 42 may be adjusted to control the amount of fluid entering the cylinder 41, as operated to perform air staging. In FIG. 5, the staging valve 40 is in a fully opened position. It is observed that the piston 47 is always radially outward of the lateral openings 42. Therefore, the piston 47 may shield the seals 49 from high pressure air or at least provide more resistance to air leaks.

Figure 7:
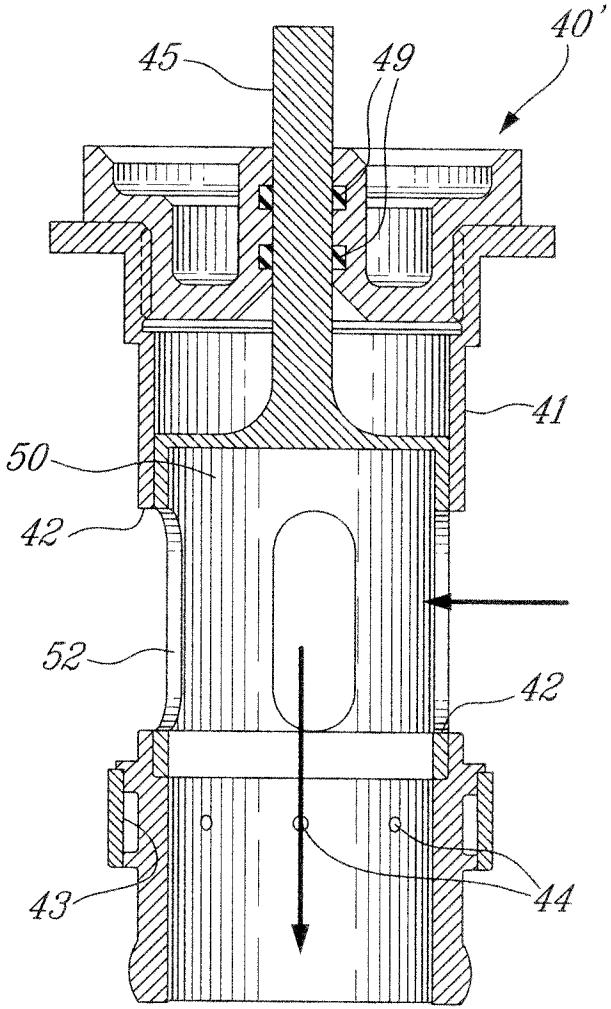
FIG. 7 is a sectioned perspective view of the rotational staging valve of FIG. 6, in an open position.
Figure 8:
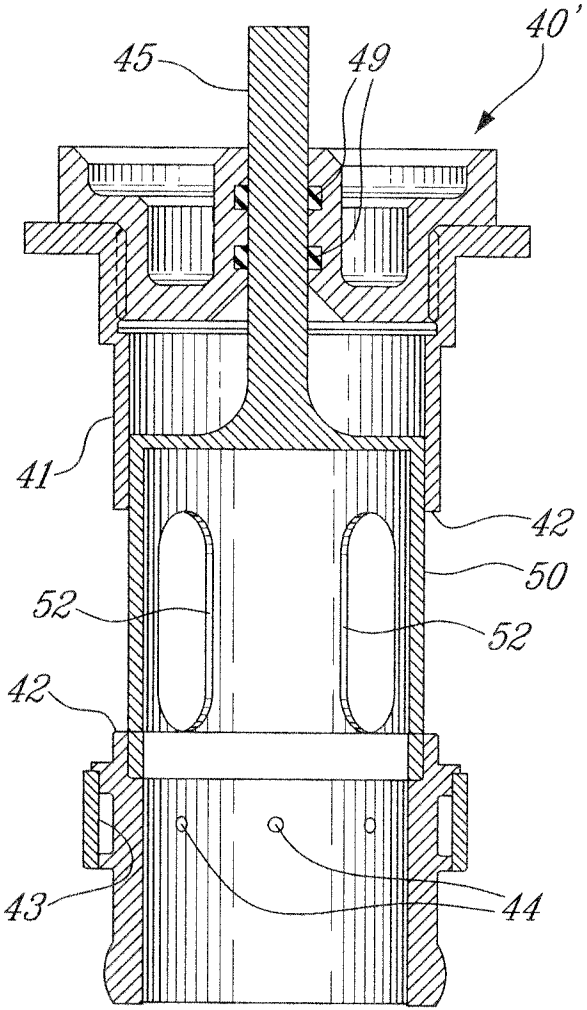

Referring to FIGS. 6 and 7, another embodiment of the staging valve is shown at 40'. As the staging valve 40 (FIGS. 4 and 5) and the staging valve 40' have common components, like numerals will be used to represent these common components.

The staging valve 40' has the cylinder 41 extending from the combustor chamber outer case to the annular portion B. The cylinder 41 may be fixedly secured to the combustor chamber outer case, for instance by way of threading engagement. The staging valves 40' may act as a combustor mounting device. Injectors 31 may then float with respect to the liner, for instance by the use of floating collars at the injection bores 22A. The radially inward end of the cylinder 41 is therefore open to the interior of the combustor. Lateral openings 42 are defined in the wall of the cylinder 41, and are located within the plenum 17 (FIGS. 2 and 3). Thus, fluid may flow from the plenum 17, to the interior of the combustor, via the cylinder 41. There may be one or more of the lateral openings 42, in any appropriate size.

A channel 43 is defined about the cylinder 41, for instance by using a sleeve, by forming an annular groove in the cylinder 41 etc. The channel 43 receives a fuel supply from any appropriate fuel supply conduit, etc. The channel 43 is in fluid communication with an interior of the cylinder 41 by way of ports 44, distributed circumferentially in the cylinder 41. The number and size of the ports 44 is a function of the amount of fuel that must be fed from the channel 43 to an interior of the cylinder 41.

The staging valve 40' of FIGS. 6 and 7 may be a rotational valve, featuring a shaft 45 that is axially located within the cylinder 41. The shaft 45 supports a valve cylinder 50 at an end, and projects outside the cylinder 41 at the opposed end.

The shaft 45 is sized such that its projecting end is located outside of the combustor chamber outer case, in such a way that the valve actuator 48 may be also located on or outside the combustor chamber outer case. Appropriate seals or packing 49 are provided between the shaft 45 and a collar of the combustor chamber outer case, to generally prevent leaks therebetween. FIGS. 6 and 7 show a pair of the seals 49, although more or less sealing means may be used.

The valve cylinder 50 may be integral with the shaft 45. The second valve 50 has one or more lateral openings 52. The number of lateral openings 52 may be equal to the number of lateral openings 42 in the cylinder 41. Therefore, a rotation of the shaft 45 may be perform to align or offset the lateral openings 52 relative to the lateral openings 42.

In FIG. 6, the staging valve 40' is in a closed position, in that the piston lateral openings 42 and 52 are offset, whereby the second cylinder 50 closes the passage of fluid from the plenum 17 (F to the interior of the combustor.

In FIG. 7, the staging valve 40' is in an open position, with the lateral openings 42 and 52 being aligned, to allow fluid to enter the combustor from the plenum 17, via the lateral openings 42 and 52. The position of the second cylinder 50 relative to the lateral openings 42 may be adjusted to control the amount of fluid entering the cylinder 41, for instance by partially offsetting the sets of openings 42 and 52, and thereby adjust the sizes of the resulting openings to perform air staging. In FIG. 7, the staging valve 40' is in a fully opened position.

The staging valves 40 and 40' can be located in either location (annular portion A and annular portion B) and, at the same time, they can act as support for the combustor, as well as acting as a support for swirlers. As shown in FIG. 2, swirlers 60 may be located within the cylinder 42, radially inwardly of the lateral openings 42.

In being used with the annular portion B, the staging valves 40 and 40' are in relatively close proximity to the combustor chamber outer case, whereby the actuators 48 may be located outside of or on the combustor chamber outer case. This could enable the use of actuators for controlling air splits or flow splits on the outside of the combustor chamber, since the mechanisms can be placed outside the plenum 17. The arrangement of the combustor 16 may be well suited for engines with centrifugal compressors, and may be used for fuel and/or air staging since the front end of the combustor may be readily accessible and close to the outer case.

The above description is meant to be exemplary only, and one skilled in the art will recognize that changes may be made to the embodiments described without departing from the scope of the invention disclosed. Any suitable liner configurations and dome shapes may be employed. The intermediate wall may have any suitable configuration, and need not be a lobed mixer but may have other mixing features or no mixing function at all. The fuel nozzles may be of any suitable type and provided in any suitable orientation. The fuel nozzles may be fed from common stems or from a common source. Any suitable diffuser arrangement may be used, and pipe type diffusers are not required nor is the radial arrangement depicted in the above examples. For example, a vane diffuser may be provided in preference to a pipe diffuser. Where axial compression is provided, another suitable arrangement for diffusion may be provided. The combustor liner and stage arrangement may be any suitable arrangement and need not be limited to the arrangement described in the examples above. Still other modifications which fall within the scope of the present invention will be apparent to those skilled in the art, in light of a review of this disclosure, and such modifications are intended to fall within the appended claims.

What is claimed is:

1. A combustor for a gas turbine engine comprising:

an inner annular liner;

an outer annular liner;

a first combustion stage and a second combustion stage defined between the inner annular liner and the outer annular liner, each said combustion stage having a plurality of fuel injection bores distributed between the inner annular liner and the outer annular liner, the first combustion stage and the second combustion stage being side-by-side in a fore portion of the combustor and curving into a common aft portion;

first air passages at the fuel injection bores of one of the combustion stages for air entry from a plenum; and valves at the fuel injection bores of the other one of the combustion stages, the valves each defining second air passage from the plenum 17 to an interior of the other one of the combustion stages, the valves each having an actuatable member for adjusting a size of a respective second air passage for air staging the combustor.

2. The combustor according to claim 1, wherein the first combustion stage and the second combustion stages extend generally radially inwardly with the second combustion stage being downstream of the first combustion stage, the valves being connected to the second combustion stage.

3. The combustor according to claim 1, wherein the fuel injection bores are provided on dome portions of the inner annular liner and the outer annular liner circumscribing the combustion stages.

4. The combustor according to claim 1, wherein the valves each have a cylinder forming said second air passage, with lateral openings in the cylinder defining an entry to said second air passage, the actuatable member of the valves being a piston axially displaced in the cylinder to adjust the size of the entry to said second air passage.

5. The combustor according to claim 4, wherein each of the pistons has a cone-like surface oriented radially inward.

6. The combustor according to claim 4, wherein the valves each comprise a second piston radially outward of the lateral openings during operation of the valves.

7. The combustor according to claim 1, wherein the valves each have a cylinder forming said second air passage, with lateral openings in the cylinder defining an entry to said air passage, the actuatable member of the valves being a valve cylinder with valve lateral openings, the valve cylinder being rotatable relative to the cylinder to align/offset the valve lateral openings with the lateral openings of the cylinder to adjust the size of the entry to said second air passage.

8. The combustor according to claim 1, wherein the valves each have a cylinder forming said second air passage, with fuel injection ports defined in a wall of the cylinder, and a channel formed about the wall of the cylinder and in fluid communication with the fuel injection ports.

9. A gas turbine engine comprising:

a combustor chamber outer casing defining a plenum;

a combustor within the plenum and comprising:

an inner annular liner;

an outer annular liner;

a first combustion stage and a second combustion stage defined between the inner annular liner and the outer annular liner, each said combustion stage having a plurality of fuel injection bores distributed between the inner annular liner and the outer annular liner, the first combustion stage and the second combustion stage being side-by-side in a fore portion of the combustor and curving into a common aft portion;

injectors at the fuel injection bores of the first combustion stage, the injectors each defining a first air passage from the plenum to an interior of the first combustion stage; and valves at the fuel injection bores of the second combustion stage, the valves each defining a second air passage from the plenum to an interior of the second combustion stage, the valves each having an actuatable member for adjusting a size of a respective air passage for air staging the combustor; and a diffuser having outlets communicating with the plenum.

10. The gas turbine engine according to claim 9, wherein the first combustion stage and the second combustion stage extend generally radially inwardly with the second combustion stage being downstream of the first stage.

11. The gas turbine engine according to claim 9, wherein the fuel injection bores are provided on dome portions of the inner annular liner and the outer annular liner circumscribing the combustion stages.

12. The gas turbine engine according to claim 9, wherein the valves each have a cylinder forming said second air passage, with lateral openings in the cylinder defining an entry to said second air passage, the actuatable member of the valves being a piston axially displaced in the cylinder to adjust the size of the entry to said air passage.

13. The gas turbine engine according to claim 12, wherein each of the pistons has a cone-like surface oriented radially inward.

14. The gas turbine engine according to claim 13, wherein the valves each comprise a second piston radially outward of the lateral openings during operation of the valves.

15. The gas turbine engine according to claim 9, wherein the valves each have a cylinder forming said second air passage, with lateral openings in the cylinder defining an entry to said second air passage, the actuatable member of the valves being a valve cylinder with valve lateral openings, the valve cylinder being rotatable relative to the cylinder to align/offset the valve lateral openings with the lateral openings of the cylinder to adjust the size of the entry to said second air passage.

16. The gas turbine engine according to claim 9, wherein the valves each have a cylinder forming said second air passage, with fuel injection ports defined in a wall of the cylinder, and a channel formed about the wall of the cylinder and in fluid communication with the fuel injection ports.

17. The gas turbine engine according to claim 9, wherein the valves each have a shaft projecting through a wall of the combustor chamber outer case, with an actuator of each said valve positioned outside of the combustor chamber outer casing.

18. The gas turbine engine according to claim 17, wherein the second combustion stage has a dome wall extending radially beyond the first combustion stage and relatively closer to the combustor chamber outer casing.

* * * * *